United States Patent [19]

Imhof

[11] Patent Number: 4,543,875

[45] Date of Patent: Oct. 1, 1985

[54] ELECTRO-HYDRAULIC DIRECTIONAL CONTROL VALVE

[75] Inventor: Rainer Imhof, Lohr, Fed. Rep. of Germany

[73] Assignee: Mannesmann Rexroth GmbH, Fed. Rep. of Germany

[21] Appl. No.: 556,436

[22] Filed: Nov. 30, 1983

[30] Foreign Application Priority Data

Dec. 7, 1982 [DE] Fed. Rep. of Germany ..... 3245259

[51] Int. Cl.[4] ..... F15B 13/044

[52] U.S. Cl. ..... 91/459; 91/461; 137/625.63; 137/625.64

[58] Field of Search ..... 91/365, 417 R, 417 A, 91/459, 461; 137/625.6, 625.61, 625.62, 625.63, 625.64

[56] References Cited

U.S. PATENT DOCUMENTS

| | | | |
|---|---|---|---|
| 2,775,982 | 1/1957 | Canfield | 91/417 R |
| 4,041,983 | 8/1977 | Bianchetta | 91/461 |
| 4,067,357 | 1/1978 | Ruchser | 137/596.16 |
| 4,201,116 | 5/1980 | Martin | 91/365 |
| 4,266,572 | 5/1981 | Schuttenberg | 137/625.64 |

FOREIGN PATENT DOCUMENTS

| | | | |
|---|---|---|---|
| 2840831 | 4/1980 | Fed. Rep. of Germany | 137/625.64 |
| 3204112 | 8/1983 | Fed. Rep. of Germany | 137/625.64 |

*Primary Examiner*—Abraham Hershkovitz
*Attorney, Agent, or Firm*—Harness, Dickey & Pierce

[57] ABSTRACT

A first front face of a main control spool of a main control valve is loaded with a constant pressure, whereas the opposite face is loaded with a controlled pressure to control the fluid passages to and from a hydraulic actuator. The control pressure is adjusted by means of a two-edge control of the pilot control spool of a pilot control valve which is actuated by a single proportional solenoid against the force of a spring. The advantages obtained thereby result in a substantial savings in manufacturing expenditure and a substantially improved control operation.

5 Claims, 1 Drawing Figure

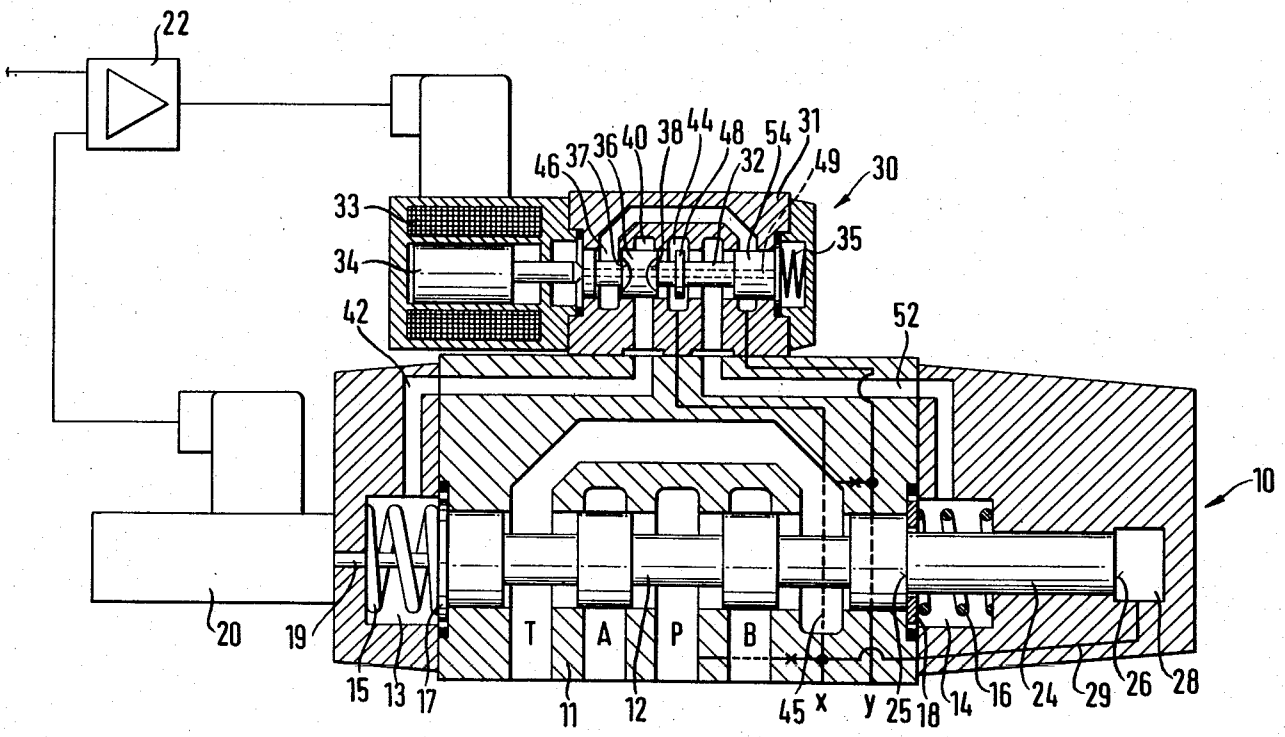
10
28
26
29
24
16
14
18
25
y
x
45
B
P
A
T
12
11
17
13
15
19
20
52
30
35
49
31
54
32
48
44
38
40
36
37
46
33
34
42
22

ELECTRO-HYDRAULIC DIRECTIONAL CONTROL VALVE

FIELD OF THE INVENTION

The present invention relates in general to an electro-hydraulic directional control valve comprising a main control valve and a pilot valve for controlling the main control valve.

DESCRIPTION OF THE PRIOR ART

German application No. 28 40 831 relates to a valve which has the advantage that the pilot valve spool is actuacted by a single proportional solenoid against the force of a single spring. To assure that in case of current failure the main control spool returns to a central position the spring above referred to urges the pilot valve spool into a further position in which both end chambers located adjacent the main valve spool are connected to the reservoir.

SUMMARY OF THE INVENTION

It is an object of the present invention to provide a directional control valve for which the complexity and expenditure of manufacturing is decreased.

It is another object of the present invention to provide a directional control valve which increases the quality of the control characteristics.

According to the present invention, a constant pressure acts upon one front face of the main control spool, whereas the pressure prevailing in the opposite end chamber of the main control spool is controlled. For this, the pilot valve spool is provided with a single land defining a pair of edge portions through which the passage leading to the control pressure chamber of the main spool is connected to a source of fluid supply or to the reservoir. The two-edge control of the pilot control spool results in a substantial reduction in manufacturing the valve. Furthermore, to shift the main control spool into a centered position when the electrical power supply fails, the pilot control spool is displaced by the spring such that both pressure chambers of the main control spool are connected to the source of fluid supply, wherein one fluid passage is established through the two-edge control and the other communication through an additional land provided on the pilot valve spool. Accordingly, no further fluid passages must be provided for the pilot valve spool.

Still further the preferred embodiment of the pilot control spool allows for an improvement in its control operation. By means of the two-edge control the pressure in the control pressure chamber may be controlled extremely fine since the rate between the stroke of displacement and pressure change is very advantageous. Accordingly, it is not necessary to determine the control position of the pilot control spool by a position sensor producing an actual position value which is additionally to be fed to the control circuitry. Rather, the position of the main control spool alone is used as actual value to produce the control signal for actuating the proportional solenoid of the pilot control valve. Thus, the control circuitry may be substantially simplified.

BRIEF DESCRIPTION OF THE DRAWINGS

Other objects and advantages of the present invention will become apparent to those skilled in the art from the following detailed description of the preferred embodiment of the invention when read in light of the accompanying drawings, wherein the single figure shows a section through a main control valve and a pilot valve.

DETAILED DESCRIPTION OF THE PREFERRED EMBODIMENT

Referring to the drawings, a main control valve 10 comprises a casing 11 and a main control spool 12 which may be displaced to connect the motor ports A and B to a source P of pressurized fluid or to the tank T. The one front face of the main control spool 12 delimits a control pressure chamber 13 and the opposite front face delimits a pressure chamber 14 which is used as a centering chamber. In both chambers centering springs 15 and 16 including spring retainers 17 and 18 are accommodated which springs center the spool 12 in the centered position as shown in which the motor ports A and B are isolated.

The respective position of the spool 12 is sensed by a plunger 19 of a position sensor 20 which converts the actual position of the spool 12 into an electrical signal representing an actual value which is fed to an electrical circuitry 22.

Adjacent the pressure chamber 14 the main control spool 12 is provided with a plunger 24 which has a diameter smaller than the diameter of the lands provided on the main control spool. As shown in the drawing, the plunger 24 is rigidly secured to the spool 12. Alternatively, the plunger 24 may be a separate piston the front face 25 of which contacts the spool 12. At its opposite front face 26, the plunger 24 delimits a further pressure chamber 28 which is connected to a pilot pressure port x through a passage 29. When the pilot valve 30 is not to be connected with the pilot control pressure port x, but rather with the pressure source P, the pressure chamber 28 must be connected to the pressure source P. That is, the pressure chamber 28 must be connected to the same pressure that is supplied to the pressure source for the pilot valve 30.

The pilot control valve 30 comprises a casing 31, a pilot control spool 32, and a proportionally operating solenoid 33 including an armature 34 adjusting the spool 32 in a first direction, whereas in the opposite direction the spool is loaded by a spring 35.

The pilot control spool 32 includes a first land 36 whose edge portions are symmetrically provided with a pair particularly shaped control notches 37 and 38 the distance of which from each other is equal or smaller than the length of the control chamber 40. Through the control notches 37, 38, i.e. the land 36, the passage 42 leading to the control pressure chamber 13 is selectively connected to the pilot pressure chamber 44 or through the passage 45 to the pilot control pressure port x or to a relief chamber 46 leading to a tank port y.

The pilot control spool 32 further comprises a land 48. Finally, the chamber housing the spring 35 is vented through a longitudinal bore 49 in the spool 32.

The operation is as follows: The pilot control spool 32 is shown in a position when no current is supplied to the solenoid 33. Accordingly, the spring 35 displaces the spool 32 into a definite position in which the main control spool 12 is centered in its central position in which the motor ports A and B are isolated. In this definite position of the spool 32 the pilot control pressure chamber 44 is connected to the passage 52 leading to the pressure chamber 14 via the land 48 opening a flow passage cross-section. Further, the pilot control pressure chamber 44 is connected to the passage 42 leading to the pressure chamber 13 via the control notch 38. The pressure chamber 28 is loaded with pilot control pressure through the passage 29 such that all chambers 13, 14, and 28 receive the same pilot control pressure in the position of the valve shown. Accordingly, the main control spool 12 is held in the centered position in which the motor ports A and B are isolated for safety.

To shift the pilot control spool 32 into a control position, the solenoid 33 must be supplied from the circuitry 22 with a signal to bring the spool 32 into a central position corresponding to a desired value of Zero. In this central position, the spool 32 is displaced to the right in the drawings, wherein the pressure chamber 14 and the passage 52 are isolated from the pilot control pressure chamber 44 by means of the land 48, but connected to the tank port y via the land 54 of the spool 32. Accordingly, the pressure chamber 14 is pressure released.

In this position in which the circuitry 22 receives a Zero desired value, the pilot control spool 32 cooperates with the proportional solenoid 33 as an electro-hydraulic three-directional control valve. The pressure in the chamber 13 acting on the front face of the main spool 12 is maintained at a certain level by means of the two-edge control of the land 36 and the control notches 37 and 38, which level corresponds to the force which is exerted by the pilot control pressure in the pressure chamber 28 on the front face of the plunger 24.

Now adjusting a desired value different from Zero in the circuitry 22, the two-edge control 37, 38 of the spool 32 is correspondingly moved such that the control pressure chamber 13 is connected to the pilot control pressure chamber 44, or, respectively, to the relief chamber 46, whereby the main control spool 12 is displaced until the spool stops at a corresponding position which is predetermined by the desired value adjusted. This position is then fed to the circuitry 22 as actual value.

What I claim is:

1. An electro-hydraulic directional control valve comprising a main control valve for controlling the communication between a pressure source, a hydraulic actuator and a fluid reservoir, said main control valve including a main control spool supported for reciprocation, springs acting on opposite ends of said main control valve spool for urging said main control valve in a centered position, a control pressure chamber formed at one end of said main control valve spool for urging said main control valve spool axially in a first direction upon pressurization of said control pressure chamber and for urging of said main control valve spool in the opposite direction upon the communication of said control pressure chamber with said reservoir, a pilot control valve including a spring biased pilot control spool and a proportional solenoid for actuating said pilot control spool against the action of said spring, said pilot control spool being movable from a neutral position toward either side thereof to respective first and second operating positions, said pilot control valve spool being operative in said first position to pressurize said control pressure chamber and in said second position being operative to communicate said control pressure chamber with said reservoir, said spring biased pilot control spool being urged to a neutral position by said spring, the improvement comprising means forming a pressure chamber acting on said main control valve spool in a direction opposite to said control pressure chamber, and means to pressurize said control pressure chamber and said pressure chamber when said spring urges said pilot control valve spool to its neutral position for maintaining said main control valve spool in a neutral position and for communicating said pressure chamber with said reservoir when said pilot control valve spool is in said first and second operating position.

2. A directional control valve according to claim 1, wherein the front face of the main control valve opposite said control pressure chamber cooperates with a plunger which diameter is smaller than the diameter of the main control spool, and wherein the plunger delimits a pressure chamber which is connected to said pressure source.

3. A directional control valve according to claim 2, wherein the plunger is rigidly connected to said main control spool.

4. A directional control valve according to claim 1, wherein said pilot control spool comprises a land having opposite control notches, and further comprises a relief chamber connected to said reservoir, a control chamber connected to said control pressure chamber of the main control spool and a pressure chamber connected to said pressure source, said chambers being arranged in this spatial sequence.

5. A directional control valve according to claim 2, wherein said pilot control spool comprises a pair of additional lands to connect the pressure chamber adjacent said plunger of the main control valve to the reservoir in the control position of the pilot control valve and to isolate said pressure chamber from the pilot control pressure chamber and to connect the pressure source to the pressure chamber in said further definite position of the pilot control valve.

* * * * *